United States Patent [19]

Werner

[11] 4,031,574

[45] June 28, 1977

[54] TIMED VENTILATOR FOR TOILETS

[76] Inventor: Frank D. Werner, Box SR9, Jackson, Wyo. 83001

[22] Filed: June 17, 1976

[21] Appl. No.: 697,139

[52] U.S. Cl. ..... 4/213; 4/72; 4/216

[51] Int. Cl.[2] ..... A47K 3/22; E03D 9/04; E03D 13/00

[58] Field of Search ..... 4/213, 209, 216, 214, 4/215, 218, 72, 83, 94, 96, 105, 106, 100, DIG. 1, 228, 222, 226

[56] References Cited

UNITED STATES PATENTS

| | | | |
|---|---|---|---|
| 2,100,962 | 11/1937 | Juntunen | 4/213 |
| 2,105,794 | 1/1938 | Norris | 4/213 |
| 2,297,935 | 10/1942 | Baither | 4/213 |
| 2,591,817 | 4/1952 | Huff | 4/213 |
| 2,881,450 | 4/1959 | Tubbs | 4/213 |
| 3,087,168 | 4/1963 | Huso | 4/213 |
| 3,102,275 | 9/1963 | Raymond | 4/213 |
| 3,295,147 | 1/1967 | Meyer | 4/213 |
| 3,366,979 | 2/1968 | Johnston | 4/213 |
| 3,486,173 | 12/1969 | Youngblood et al. | 4/112 |
| 3,626,554 | 12/1971 | Martz | 4/213 |
| 3,691,568 | 9/1972 | Martz | 4/213 |
| 3,763,505 | 10/1973 | Zimmerman | 4/213 |
| 3,781,923 | 1/1974 | Maisch et al. | 4/213 |
| 3,887,948 | 6/1975 | Stamper | 4/72 |
| 3,900,908 | 8/1975 | Stump | 4/213 |
| 3,939,506 | 2/1976 | Pearson | 4/213 |

FOREIGN PATENTS OR APPLICATIONS

| | | | |
|---|---|---|---|
| 2,259,046 | 6/1974 | Germany | 4/209 |

*Primary Examiner*—Henry K. Artis
*Attorney, Agent, or Firm*—Dugger, Johnson & Westman

[57] ABSTRACT

A timed ventilator for toilets which mounts entirely within the toilet tank, and which operates from a battery power source to remove air from the toilet bowl and move the air through a charcoal filter for deodorizing. An external control includes an automatic time delay which will hold the fan on for a desired amount of time necessary to change the air in the small volume of the toilet bowl.

8 Claims, 4 Drawing Figures

FIG. 1
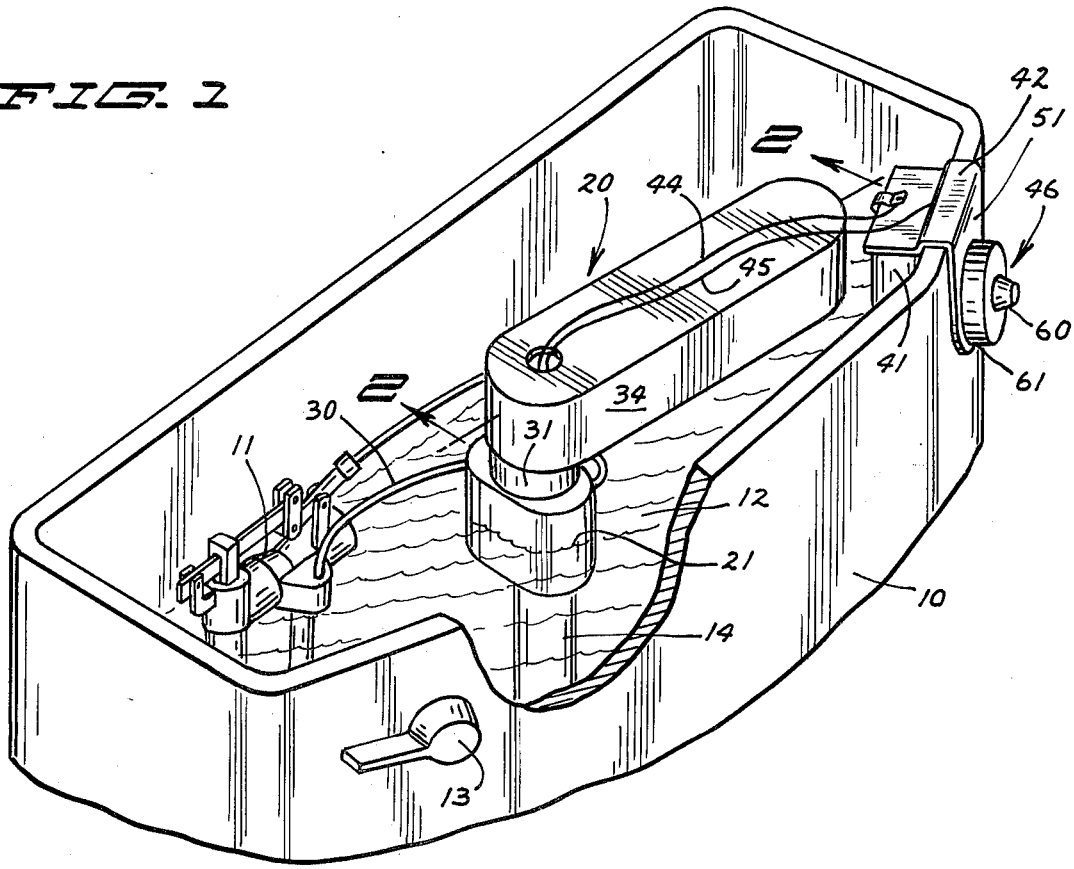
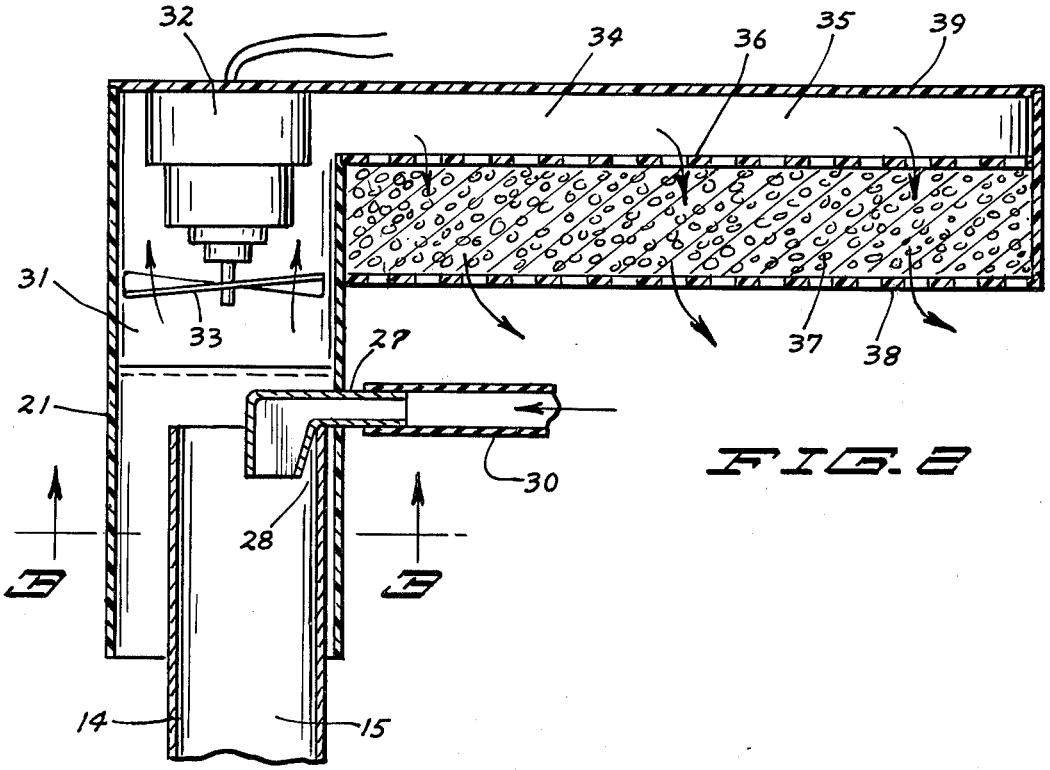
FIG. 2

TIMED VENTILATOR FOR TOILETS

BACKGROUND OF THE INVENTION

1. Field of the Invention

The present invention relates to ventilators and deodorizers for toilet bowls.

2. Prior Art

In the prior art, there are a wide number of various ventilators for home and industrial toilets. Some of these also use activated charcoal as a filtering element for removing odors. U.S. Pat. No. 3,087,168 to M. A. Huso illustrates a filter unit that mounts, in one form, on the interior of the toilet tank, and also in another form on the exterior of the tank, and which includes a fan for ventilating the toilet bowl and passing the air through an acitvated charcoal filter. U.S. Pat. No. 3,781,923 illustrates a ventilating system which is mounted into a hollow cover which replaces the standard cover on the tank of a water closet or toilet. In this device electrical controls also can be included for flushing the toilet.

U.S. Pat. No. 3,626,554 shows a suction hood directly mounted onto the overflow pipe on the interior of the toilet tank, which hood is connected to an external blower. U.S. Pat. No. 2,881,450 shows a blower unit mounted directly to an overflow pipe of a toilet with electrical controls, and apparently there is a holding circuit which is under control of floats in the tank which opens to disable the blower unit when the water level rises.

U.S. Pat. No. 3,763,505 shows a ventilating unit mounted inside a tank in a special housing, utilizing the overflow pipe for ventilation of the toilet bowl in one form of the invention, and includes battery power for driving the motor for the fan together with a timer switch for operation.

U.S. Pat. No. 2,591,817 includes a damper mounted on the overflow pipe which controls the flow of vapor from the water tank into the bowl when the water in the closet rises during filling.

U.S. Pat. No. 3,939,506 shows a ventilator that has an exhaust conduit connected to the upper portion of the water tank of the toilet to withdraw air from the toilet bowl through the overflow pipe, with a fan located in the attic of a house in which the device is used.

SUMMARY OF THE INVENTION

The present invention relates to a small compact unit for ventilating water closets or toilets, which mounts onto the overflow pipe, and is contained, except for the activating switch assembly, entirely within the water supply tank. This makes the unit unobtrusive, and yet it is easy to install. Means are included for securely wedging the main housing onto the upper edge of the overflow pipe when the unit is installed so that it is securely held without any external fasteners. The interior unit is small enough so that it can be positioned in a desired location to avoid interfering with any other mechanism in the water supply tank.

The timer switch is used for operating a battery powered fan, used for safety purposes, and the batteries are positioned inside the tank but adjacent to the switch so that the batteries can easily be replaced.

The time delay device is made to be operated on a pneumatic principle using molded parts that fit together to provide the necessary pneumatic time delay orifice.

The entire device can be installed without any special tools. The blower is simple to make because of the small volume that is required to be moved, when removing air only from the toilet bowl. Battery life is adequate and the time delay avoids excessive battery drain that can result from leaving the unit on for an unnecessary length of time. The low voltage batteries are safe to use, and no high voltage power is necessary.

BRIEF DESCRIPTION OF THE DRAWINGS

FIG. 1 is a perspective view of a typical toilet tank illustrating a ventilator made according to the present invention installed thereon;

FIG. 2 is a sectional view taken as on line 2—2 in FIG. 1;

DESCRIPTION OF THE PREFERRED EMBODIMENT

Figure 3:
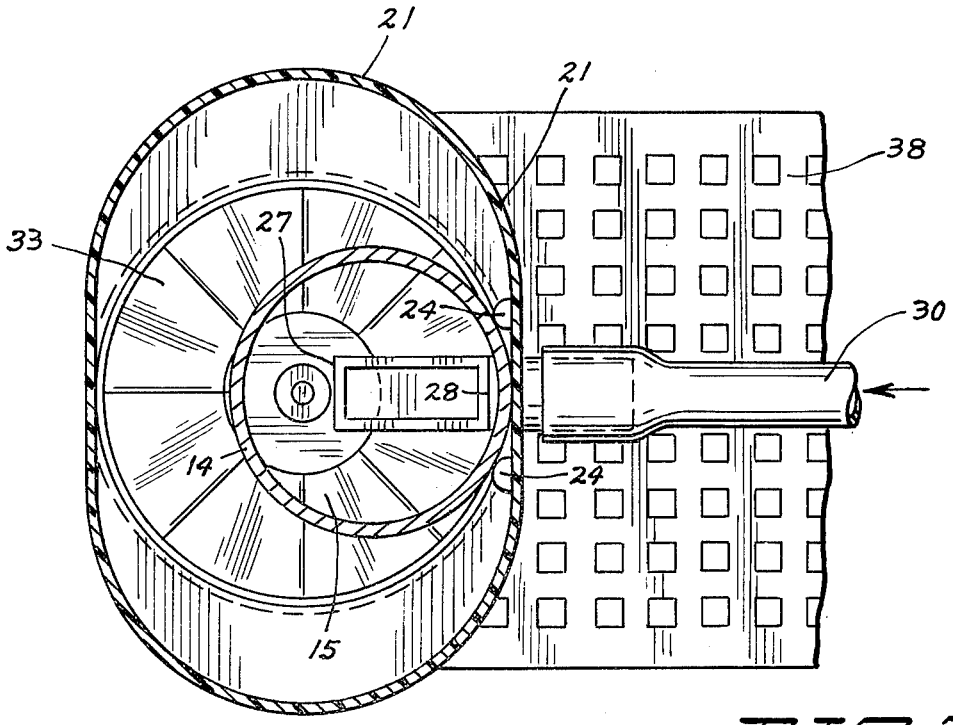
FIG. 3 is a sectional bottom view taken as on line 3—3 in FIG. 2.

In FIG. 1, a standard toilet tank 10 is connected to a toilet bowl in the normal manner, and includes flushing controls 11, which are used for flushing the toilet and refilling the tank with water, which is indicated generally at 12. The flushing controls are operated through an exterior handle 13. Reference can be made to the prior art for further detailed showings of toilets. The toilet tank overflow pipe 14, which is provided on all standard toilets leads directly to the toilet bowl (not shown) through a rim around the edge of the bowl so that water can overflow from the tank into the bowl if the refill mechanism and float do not work properly. Further, a refill jet or orifice discharges water through this passage to the bowl to refill the trap of the bowl after flushing, as the tank is refilled. The overflow pipe provides an air passage indicated generally at 15 to the toilet bowl. The normal refill pipe normally passes over the edge of the overflow pipe 14 into the passage 15 for refilling the trap in the toilet bowl.

In the device of the present invention, the blower and filter assembly illustrated generally at 20 includes a support housing 21, which is of size to fit over and be spaced from the overflow pipe 14, and a refill nozzle 27 is molded into one side of the housing 20 and fastened securely thereto. The refill nozzle 27 has a rectilinear cross section, as shown in FIG. 3, and the back wall 28 of the nozzle, which is adjacent one of the walls of the mounting housing 21 is also positioned adjacent and centered between a pair of ribs 24,24 which are fastened to one wall of the housing 21 as shown also in FIG. 3. These ribs 24 then serve to wedge the back wall 28 of the refill nozzle 27 against the overflow pipe 14 so that the upper portion of the overflow pipe is pinched between the ribs 24 and the back wall 28 of the nozzle. In this way the tapered back wall 28 will clamp or wedge down on the overflow pipe and securely hold the housing 21 on the overflow pipe. A refill tube 30 can then easily be installed onto the refill nozzle 28 from the provided refill orifice of the flushing control. The refill tube 30 leads from the flush control mechanism 11 as shown in FIG. 1.

The housing 21 is open at is lower end as shown, and skirt portions of the housing are spaced from the overflow pipe 14, but are below the water level when the refill tank is full. At the upper end of the housing 21 there is a passageway 31 formed in which a small fan motor 32 is mounted, with a fan blade 33 that is of size to fit within and rotate within the passage 31 with a small amount of clearance. When the fan motor 32 is operating, the air will move up through the overflow pipe 14 and past the fan blade 33, and over into a filter compartment 34. The passageway 31 leads to a chamber 35 that is above a perforated or apertured dividing wall 36, and below which a filter material 37 such as activated charcoal or other known odor removal material is packed. A lower perforated wall 28 leads to the exterior of the filter compartment. It should be noted that the upper wall 39 of the filter compartment 34 is sealed so that the air drawn by the fan must pass through the filter 37 into the interior of the water tank. The fan motor 32 is fixed to the wall 39.

After refilling water in the tank so the lower edge of housing 21 is below the water the only passage for air to the fan is through the passageway 15. Also, the spacing of the skirt or wall of housing 21 from the overflow pipe permits water to flow from the tank into the overflow pipe if necessary, even after the ventilator has been installed.

The fan motor 32 is operated from a battery source in a holder indicated generally at 41, which is mounted in turn on the interior of the water tank 10 and is mounted onto a clip 42 that fits over the top lip of the tank. The clip is thin enough to pass under the tank cover without substantial dislocation of the cover. Batteries indicated generally at 43, for example two D cell flashlight batteries, are mounted in the battery holder 41 and are connected through suitable clips and a switch to power wires 44 and 45. Wire 45 is connected to a switch indicated generally at 46 which includes spring loaded contacts on arms 53 and 54.

Figure 4:
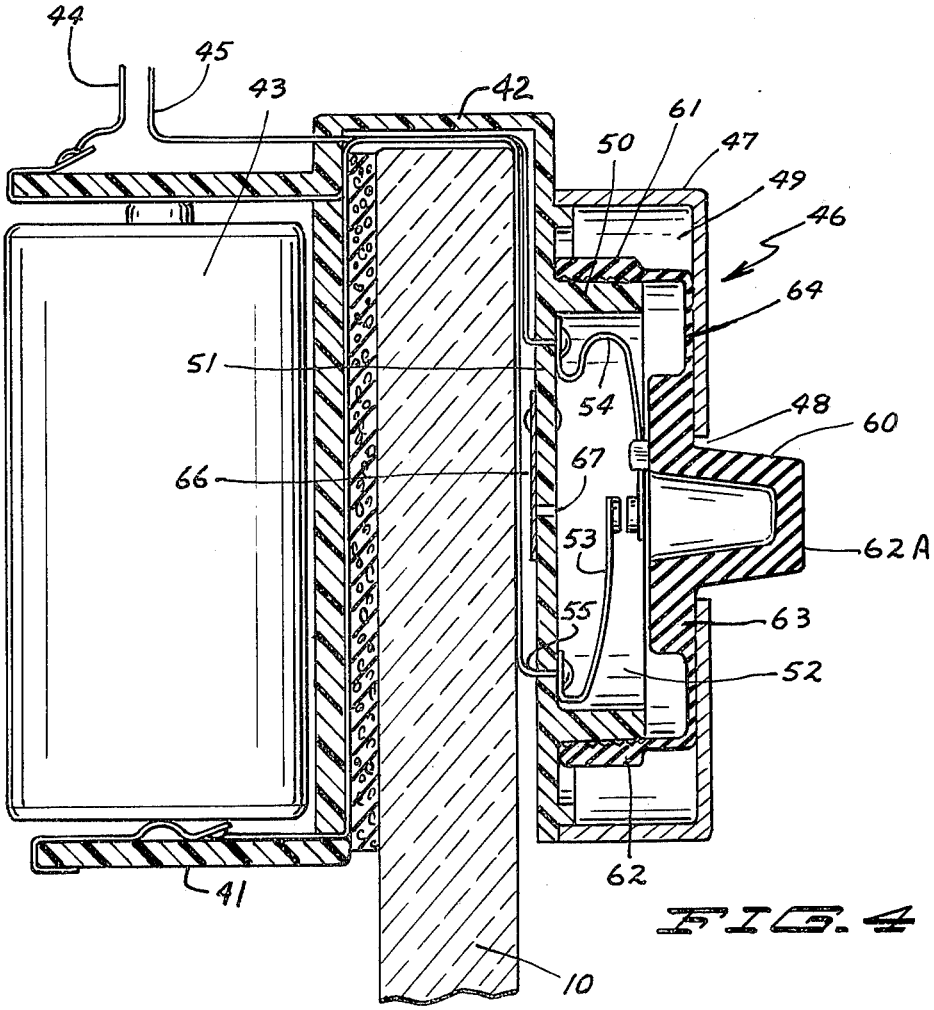
FIG. 4 is a sectional view of an activating switch and time delay mechanism and the battery housing used with the present invention.

The switch 46 is a time delay switch and as shown, the clip 43 supports an outer housing 47 which has a center aperture 48, and which defines an interior chamber 49. the clip 42 also has an annular or cylindrical neck 50 that extends outwardly from the wall of the tank and from the back wall 51 of the clip to define a cylindrical interior chamber 52. A first switch spring contact 53 is mounted on the wall 51 inside the chamber 52, and a second switch spring contact arm 54 is also mounted to wall 51. Arm 54 is spring loaded away from the contact on arm 53, as shown in FIG. 4. The contact arm 54 is to the exterior of the contact arm 53. Contact arm 53 is connected to wire 55 that leads from one end of the batteries. Contact arm 54 is connected to wire 45 so that a circuit is completed across the batteries through the contact arms 53 and 54 when the end contacts are touching.

A flexible, molded elastomeric diaphragm and push button member illustrated generally at 60 includes an outer rim 61 that has interior threads indicated generally at 62 to provide a frictional gripping on the exterior surface of the collar 50, and at the same time provide a controlled air leakage past the seal. The diaphragm has a pushbutton portion 62A that extends through opening 48. A boss portion 63 is positioned on the interior of wall 47 and is adjacent to and touches contact arm 54. The central boss 63 and the pushbutton 62A are attached to the rim 61 by a flexible sealing wall 64.

The diaphragm assembly therefore encloses and seals the chamber 52 with a flexible wall.

The diaphragm portion 64 are flexible, and permit the button 62 to be pressed inwardly into the interior chamber 52 defined by the collar 50. Because the chamber 52 is sealed by the diaphragm, when the button is depressed the air in chamber 52 will be compressed. This will cause discharge of air out through a flapper valve assembly 66 that covers a small aperture 67 in the wall 51. The flapper valve is a one way check valve, that permits air to be discharged from chamber 52 but prevents air from being drawn back into the chamber through the aperture 67. When the diaphragm button 62A is depressed the contacts 53 and 54 will be pushed together to complete the circuit to the fan motor 32. The spring contact arms 53 and 54 will urge the diaphragm outwardly from the chamber 52, but in order to move out, replacement air must be drawn in. Air is drawn into chamber 52 past the threads 62 on the rim 61 as the diaphragm moves out. The amount of thread, the tension of the rim 61 and the characteristics of the outer surface of the collar 50 can be controlled so that a delay in return of the diaphragm to its condition shown in FIG. 4 with the contact arm separated can be caused. Approximately a 3 minute delay from the time of depressing button 62A and starting motor 32 until the contacts open and motor 32 stops is utilized in the present device. Running the fan for 3 minutes has been found to be satisfactory for deodorizing purposes.

Thus, a simple pneumatic time delay device is utilized and the delay does not require electrical power. This means that the power from the batteries 43 is used entirely for driving the fan motor. The fan will only be on for limited periods of time each time the button 62A is depressed.

It can be seen taht the battery and switch holder can easily be slipped over the tank wall and the batteries can easily be replaced because they are positioned adjacent the front edge of the tank.

The filter housing 34 can be mounted in alternate locations. In other words, the filter unit 34 can be reversed in direction of extension from pipe 14 from that shown and extend over toward the flush controls 11 if desired.

The device is easy to make, easy to install, relatively low in cost and inherently safe. It is unobtrusive and because of low power consumption and insurance that the fan will not continue to run, the batteries last a substantial time.

What is claimed is:

1. A ventilator for toilets having a water supply tank and an overlap pipe in the tank open to the toilet bowl comprising a housing supported on said overflow pipe on the interior of said tank, said housing including wall means defining a passageway open to said overflow pipe, a filter compartment open to said passageway and having an air discharge side opening to the interior of said tank, fan means in said passageway for causing air flow from the overflow pipe through said passageway and said filter compartment, a power supply and control for said fan mounted on said tank and including a control member on the exterior of said tank for manual operation, said control comprising a manually depressable button completing a circuit to said fan and pneumatic delay means to resist return of said circuit to open position said pneumatic delay means comprising a chamber coupled to said button whereby depressing said button changes the size of said chamber, means tending to return the chamber to its original size, and means to permit air to bleed relative to said chamber at a controlled rate.

2. The ventilator of claim 1 including a nozzle protruding into said passageway, said nozzle having a nozzle wall spaced from one of the wall means defining said passageway and said nozzle wall being inclined with respect to said one wall means to permit wedging portions of said overflow pipe between said nozzle wall and said one wall means.

3. The ventilator of claim 1 wherein said control comprises said pair of contacts enclosed in a chamber, movable wall means defining a wall of said chamber, said button when depressed moving said movable wall, and causing said contacts to close, check valve means to permit air to flow out of said chamber as the button is depressed and means to bias said movable wall in a direction to expand said chamber after the button has been depressed and released.

4. The ventilator of claim 3 wherein said movable wall comprises a molded diaphragm member, said chamber being defined by a cylindrical wall, a rim on said diaphragm of size to fit over and engage said cylindrical wall to enclose said chamber, said means to permit controlled bleed of air into said chamber comprises the engaging surfaces of said cylindrical wall and said rim.

5. The ventilator of claim 4 wherein said means to bias comprises spring contact arms carrying said contacts.

6. The ventilator of claim 1 wherein said power supply and control comprises a battery case and controlled housing forming a saddle bracket mountable over a wall of said tank with the battery case on the interior of said tank and the control housing on the exterior thereof.

7. The ventilator of claim 6 wherein said control housing has a forward wall, said chamber being defined inside said control housing and including a movable wall, said button protruding through said forward wall and connected to said movable wall whereby depressing said button causes said movable wall to move from a normal position to cause reduction of volume of said chamber, check valve means to permit air to be expelled from said chamber when the button is depressed.

8. A ventilator for toilets having a water supply tank and an overflow pipe in the tank open to the toilet bowl comprising a housing supported directly on said overflow pipe only on the interior of said tank and contained within said tank, said housing including wall means defining a passageway open to said overflow pipe, a filter compartment open to said passageway and having an air discharge side opening to the interior of said tank, fan means in said passageway for causing airflow from the overflow pipe through said passageway and said filter compartment, a power supply and control for said fan mounted on said tank and including a control member on the exterior of said tank for manual operation, said housing including a refill nozzle protruding into said passageway, said nozzle having a nozzle wall spaced from one of the wall means defining said passageway, and said nozzle wall being inclined with respect to said one wall means to permit wedging portions of said overflow pipe between said nozzle wall and said one wall means.

* * * * *

UNITED STATES PATENT AND TRADEMARK OFFICE

CERTIFICATE OF CORRECTION

PATENT NO. : 4,031,574

DATED : June 28, 1977

INVENTOR(S) : Frank D. Werner

It is certified that error appears in the above-identified patent and that said Letters Patent are hereby corrected as shown below:

Column 3, line 37 "43" should be--42--; Column 3, line 66 "portion" should be--portions--. Column 4, line 49, (Claim 1, line 2), "overlap" should be--overflow--; Column 4, line 55, (Claim 1, line 7), after air insert a hyphen --(-)--. Column 5, line 9, (Claim 3, line 2), "a" should be--said--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*